US009790442B2

(12) United States Patent
Cox et al.

(10) Patent No.: US 9,790,442 B2
(45) Date of Patent: Oct. 17, 2017

(54) SELECTIVE HYDROGENATION METHOD

(71) Applicant: UOP LLC, Des Plaines, IL (US)

(72) Inventors: Pelin Cox, Des Plaines, IL (US); Deng-Yang Jan, Elk Grove Village, IL (US)

(73) Assignee: UOP LLC, Des Plaines, IL (US)

( * ) Notice: Subject to any disclaimer, the term of this patent is extended or adjusted under 35 U.S.C. 154(b) by 134 days.

(21) Appl. No.: 14/574,311

(22) Filed: Dec. 17, 2014

(65) Prior Publication Data

US 2016/0176783 A1 Jun. 23, 2016

(51) Int. Cl.

| | |
|---|---|
| ***C10G 70/02*** | (2006.01) |
| ***C10G 25/03*** | (2006.01) |
| ***C10G 25/05*** | (2006.01) |
| ***C10G 45/32*** | (2006.01) |
| ***C10G 45/40*** | (2006.01) |
| ***C10G 25/00*** | (2006.01) |
| ***C10G 45/00*** | (2006.01) |
| ***C10G 67/06*** | (2006.01) |
| ***C10G 70/04*** | (2006.01) |

(52) U.S. Cl.

CPC ..... *C10G 70/02* (2013.01); *C10G 25/00* (2013.01); *C10G 25/03* (2013.01); *C10G 45/00* (2013.01); *C10G 45/32* (2013.01); *C10G 67/06* (2013.01); *C10G 70/046* (2013.01)

(58) Field of Classification Search

None

See application file for complete search history.

(56) References Cited

U.S. PATENT DOCUMENTS

| | | | | |
|---|---|---|---|---|
| 3,296,324 | A * | 1/1967 | Csicsery | C07C 2/00 585/417 |
| 3,660,967 | A * | 5/1972 | Collins | B01D 53/02 95/137 |
| 4,274,942 | A | 6/1981 | Bartholic | |
| 4,769,128 | A | 9/1988 | Boyle | |
| 4,806,699 | A | 2/1989 | Smith | |
| 4,861,930 | A * | 8/1989 | Cottrell | C07C 2/76 585/269 |
| 5,155,075 | A | 10/1992 | Innes | |
| 5,198,397 | A | 3/1993 | Raterman | |

(Continued)

FOREIGN PATENT DOCUMENTS

| | | | |
|---|---|---|---|
| EP | 650395 | B1 | 9/1999 |
| EP | 1390135 | B1 | 10/2009 |

(Continued)

OTHER PUBLICATIONS

Scruton, "Cyclar process tested: aromatics from LPG", The Institute of Petroleum, Petroleum Review, Jun. 1991, p. 270-272.

(Continued)

*Primary Examiner* — Philip Louie

(57) ABSTRACT

The present subject matter relates generally to methods for selectively saturating the unsaturated $C_2$-$C_4$. More specifically, the present subject matter relates to methods for saturating butadiene and butenes from a hydrocarbon stream before it is combined with a fresh feed and enters a reaction zone. Removing the unsaturates from the hydrocarbon stream before the hydrocarbon stream enters the reaction zone prevents the reactor internals from coking.

16 Claims, 2 Drawing Sheets

(56) References Cited

U.S. PATENT DOCUMENTS

| | | | | |
|---|---|---|---|---|
| 5,248,408 | A | 9/1993 | Owen | |
| 5,271,835 | A * | 12/1993 | Gorawara | C10G 70/00 208/203 |
| 5,597,537 | A | 1/1997 | Wegerer | |
| 5,866,735 | A * | 2/1999 | Cheung | B01J 23/44 585/259 |
| 6,660,158 | B1 | 12/2003 | Ellingsen | |
| 6,916,417 | B2 | 7/2005 | Mayes | |
| 6,977,317 | B1 * | 12/2005 | Frey | C10G 45/00 585/258 |
| 7,470,644 | B2 | 12/2008 | Dirkx | |
| 7,915,191 | B2 | 3/2011 | Hedrick | |
| 8,716,161 | B2 | 5/2014 | Wu | |
| 8,835,706 | B2 | 9/2014 | Iyer | |
| 2009/0114093 | A1 * | 5/2009 | Li | B01D 53/02 95/135 |
| 2011/0168604 | A1 * | 7/2011 | van Egmond | C10G 45/02 208/57 |
| 2012/0302433 | A1 | 11/2012 | Peat | |
| 2013/0131414 | A1 | 5/2013 | Iyer | |

FOREIGN PATENT DOCUMENTS

| | | | |
|---|---|---|---|
| RU | 2497929 | C1 | 11/2013 |
| WO | 2014144855 | A2 | 9/2014 |

OTHER PUBLICATIONS

Claude, "Holding the Key", Reprinted from Hydrocarbon Engineering, Mar. 2008, www.hydrocarbonengineering.com.
Letzsch, "Stone & Webster—Institut Francais du Petrole Fluid RFCC Process" Catalytic Cracking, Chapter 3.4, p. 3.71-3.94.
Palmas, "25 Years of Development", Reprinted from Hydrocarbon Engineering, Jun. 2009, www.hydrocarbonengineering.com.
U.S. Appl. No. 14/574,303, filed Dec. 17, 2014, Cox et al.
U.S. Appl. No. 14/574,293, filed Dec. 17, 2014, Jan et al.
U.S. Appl. No. 14/574,288, filed Dec. 17, 2014, Cox et al.

* cited by examiner

SELECTIVE HYDROGENATION METHOD

FIELD

The present subject matter relates generally to methods for selectively saturating the unsaturated $C_2$-$C_4$. More specifically, the present subject matter relates to methods for saturating butadiene and butenes from a hydrocarbon stream before it is combined with a fresh feed and enters a reaction zone. Removing the unsaturates from the hydrocarbon stream before the hydrocarbon stream enters the reaction zone prevents the reactor internals from coking.

BACKGROUND

Dehydrocyclo-oligomerization is a process in which aliphatic hydrocarbons are reacted over a catalyst to produce aromatics and hydrogen and certain byproducts. This process is distinct from more conventional reforming where $C_6$ and higher carbon number reactants, primarily paraffins and naphthenes, are converted to aromatics. The aromatics produced by conventional reforming contain the same or a lesser number of carbon atoms per molecule than the reactants from which they were formed, indicating the absence of reactant oligomerization reactions. In contrast, the dehydrocyclo-oligomerization reaction results in an aromatic product that typically contains more carbon atoms per molecule than the reactants, thus indicating that the oligomerization reaction is an important step in the dehydrocyclo-oligomerization process. Typically, the dehydrocyclo-oligomerization reaction is carried out at temperatures in excess of 260° C. using dual functional catalysts containing acidic and dehydrogenation components.

Aromatics, hydrogen, a $C_{4+}$ non-aromatics byproduct, and a light ends byproduct are all products of the dehydrocyclo-oligomerization process. The aromatics are the desired products of the reaction as they can be utilized as gasoline blending components or for the production of petrochemicals. Hydrogen is also a desirable product of the process. The hydrogen can be efficiently utilized in hydrogen consuming refinery processes such as hydrotreating or hydrocracking processes. The least desirable product of the dehydrocyclo-oligomerization process is light ends byproducts. The light ends byproducts consist primarily of $C_1$ and $C_2$ hydrocarbons produced as a result of the cracking side reactions.

The uncoverted aliphatic hydrocarbons and a portion of cracking products from dehydrocyclodimerization reactor is separated, recovered and combined with the fresh feed, before entering the reactor. This recycle stream contains diolefins, mainly butadiene and $C_2$-$C_4$ olefins and aromatics. Olefins that are in the recycle stream are thermally converted to diolefins in the heater train. Some other products of the dehydrocyclo-oligomerization process are also not desirable. For example, di-olefins such as butadiene are known to cause pyrolytic coking of reactor internals and thus builds up pressure of reactors.

Accordingly, it is desirable to develop methods for saturating butadiene and butenes before the recycle stream is combined with the fresh feed and enters the reaction zone. Furthermore, other desirable features and characteristics of the present embodiment will become apparent from the subsequent detailed description and the appended claims, taken in conjunction with the accompanying drawings and this background.

SUMMARY

A first embodiment is a method for saturating hydrocarbons including passing a hydrocarbon stream to a guard bed wherein the hydrocarbon stream is contacted with an adsorbent to form a treated hydrocarbon stream. The treated hydrocarbon stream and a hydrogen stream are then passed to a reaction zone containing a hydrogenation catalyst to form a reaction zone effluent stream. The hydrocarbon stream may include light paraffins, olefins, diolefins mainly butadiene, aromatics, water, hydrogen sulfide, and other sulfur containing compounds. Saturating the unsaturates prevents the reactor internals from coking.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

DEFINITIONS

As used herein, the term "dehydrocyclodimerization" is also referred to as aromatization of light paraffins. Within the subject disclosure, dehydrocyclodimerization and aromatization of light hydrocarbons are used interchangeably.

As used herein, the term "stream", "feed", "product", "part" or "portion" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated $C_1$, $C_2$, $C_3$, Cn where "n" represents the number of carbon atoms in the one or more hydrocarbon molecules or the abbreviation may be used as an adjective for, e.g., non-aromatics or compounds. Similarly, aromatic compounds may be abbreviated $A_6$, $A_7$, $A_8$, An where "n" represents the number of carbon atoms in the one or more aromatic molecules. Furthermore, a superscript "+" or "−" may be used with an abbreviated one or more hydrocarbons notation, e.g., $C_{3+}$ or $C_{3-}$, which is inclusive of the abbreviated one or more hydrocarbons. As an example, the abbreviation "$C_{3+}$" means one or more hydrocarbon molecules of three or more carbon atoms.

As used herein, the term "zone" can refer to an area including one or more equipment items and/or one or more sub-zones. Equipment items can include, but are not limited to, one or more reactors or reactor vessels, separation vessels, distillation towers, heaters, exchangers, pipes, pumps, compressors, and controllers. Additionally, an equipment item, such as a reactor, dryer, or vessel, can further include one or more zones or sub-zones.

As used herein, the term "rich" can mean an amount of at least generally 50%, and preferably 70%, by mole, of a compound or class of compounds in a stream.

As used herein, the term "substantially" can mean an amount of at least generally 80%, preferably 90%, and optimally 99%, by mole or weight, of a compound or class of compounds in a stream.

As used herein, the term "active metal" can include metals selected from IUPAC Groups that include 6, 7, 8, 9, 10, and 13 such as chromium, molybedenum, tungsten, rhenium, cobalt, nickel, platinum, palladium, rhodium, iridium, ruthenium, osmium, gallium, indium, copper, silver, zinc, and mixtures thereof.

As used herein, the term "modifier metal" can include metals selected from IUPAC Groups that include 11-17. The IUPAC Group 11 trough 17 includes without limitation sulfur, gold, tin, germanium, and lead.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

The following detailed description is merely exemplary in nature and is not intended to limit the application and uses of the embodiment described. Furthermore, there is no intention to be bound by any theory presented in the preceding background or the following detailed description.

Figure 1:
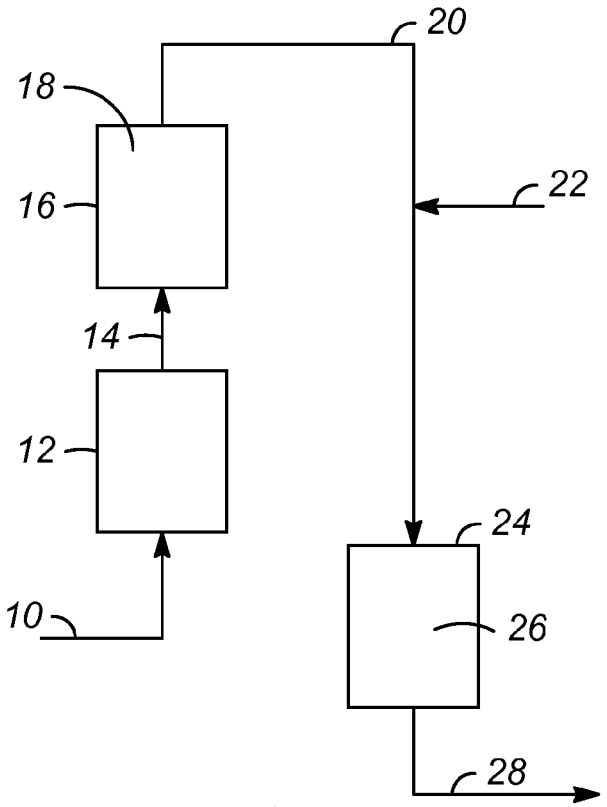
FIG. 1 is a schematic depiction of one embodiment of the method for saturating hydrocarbons.

In one embodiment as depicted in FIG. 1, the hydrocarbon feed 10 passes through a dryer 12 producing a dried hydrocarbon stream 14. The dried hydrocarbon stream 14 then passes through a guard bed 16 to remove $H_2O$, $H_2S$, and other sulfur containing compounds to give a pretreated hydrocarbon stream 20. The pretreated hydrocarbon stream 20 contains reduced contents of $H_2O$, $H_2S$, and other sulfur containing compounds. The amounts of $H_2O$ and sulfur contents are around 10-1000 and 20-1000 mol ppm (on an elemental sulfur basis), respectively. The amounts of $H_2O$ and sulfur containing compounds in the pretreated stream 20 are less than 20 and 1 mol ppm and preferably less than 10 and 0.1 mol ppm, respectively.

The pretreated hydrocarbon stream 20 is combined with a $H_2$ stream 22 and then enters the selective hydrogenation reactor 24. The selective hydrogenation reactor 24 contains the selective hydrogenation catalyst 26. The selective hydrogenation catalyst 26 is made up of at a least one hydrogenation component selected from Groups 6 through 10 supported on inorganic oxides to effect the utilization. Preferably the hydrogenation catalysts are made up of nickel, cobalt, palladium, platinum, copper, zinc, silver, gallium, indium, germanium, tin and the mixture of thereof, supported in inorganic oxides such as alumina, silica, magnesia and the mixture of thereof. The supports can take the shapes of extrudates and spheres; in particular ones that possess high geometric surface area to volume ratios. In addition, the catalyst may contain alkali or alkali earth elements. More preferably the catalysts are made up of palladium, platinum, and mixtures thereof. The total amount of metals is greater than 0.05 wt %, more preferably greater than 0.2 wt % and most preferably greater than 0.40 wt %. In addition the catalyst may contain elements selected from alkali and alkali earth groups at a level greater than 0.1 wt %. Furthermore, substantial amounts of the active metal components are located within 200 um from the exterior of the catalysts and preferably within 100 um from the exterior of the catalyst. The butadiene and olefin are preferentially saturated over aromatics at levels of greater than 50% and preferably greater than 70% with aromatics saturations maintained at less than 10%, preferably less than 5% and most preferably less than 2%. The operating pressures range from 40 psig to 300 psig, temperatures range from 60° C. to 350° C., hydrogen to olefin ratios from about 0.5 to about 4.0 and space velocity from 2 to 50 hr−1 WHSV.

Figure 2:
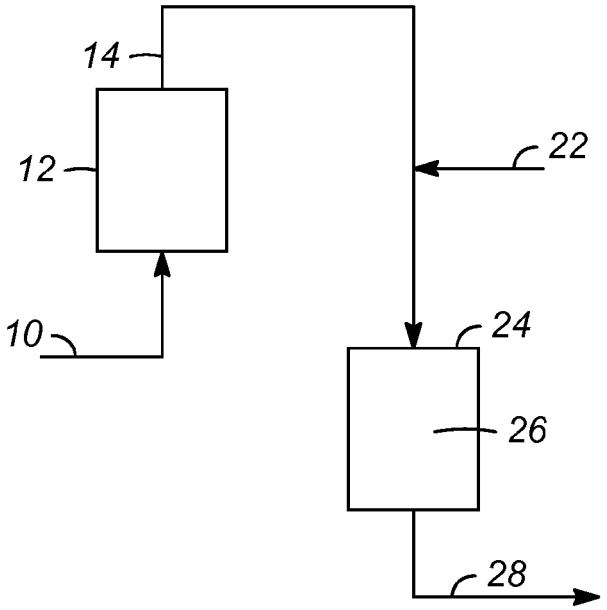
FIG. 2 is a schematic depiction of another embodiment of the method for saturating hydrocarbons.

In another embodiment, the guard bed is designed to remove $H_2O$, while leaving $H_2S$ and sulfur containing compounds relatively intact as depicted in FIG. 2. In this embodiment illustrated in FIG. 2, the hydrocarbon stream 10 passes through a dryer 12 and the pretreated hydrocarbon 14 is combined with a hydrogen stream 22 before entering the selective hydrogenation reactor 24. It is also contemplated that if the $H_2O$ content is low, for example a $H_2O$ content of around 100 ppm, there would be no need for a dryer. The selective hydrogenation reactor 24 contains the selective hydrogenation catalyst 26 made up of at a least a hydrogenation component selected from Groups 6 through 10 supported on inorganic oxides to effect the utilization. Preferably the hydrogenation catalysts are made up of nickel, cobalt, chromium, molybedinum, palladium, platinum, and the mixture of thereof, supported in inorganic oxides such as alumina, silica, magnesia and the mixture of thereof. Most preferably the selective hydrogenation catalysts are made up of nickel, cobalt, molybedenum, tungsten and mixtures of thereof. The total amount of metals is greater than 0.5 wt %, preferably greater than 2% and most preferably greater than 5%. The butadiene and olefin are preferentially saturated over aromatics at levels of greater than 50% and preferably greater than 70% with aromatics saturations maintained at less than 10%, preferably less than 5% and most preferably less than 2%. The operating pressures range from 40 to 300 psig and temperatures range from 60 to 350° C. and hydrogen to olefin ratios from about 0.5 to about 4.0.

Figure 3:
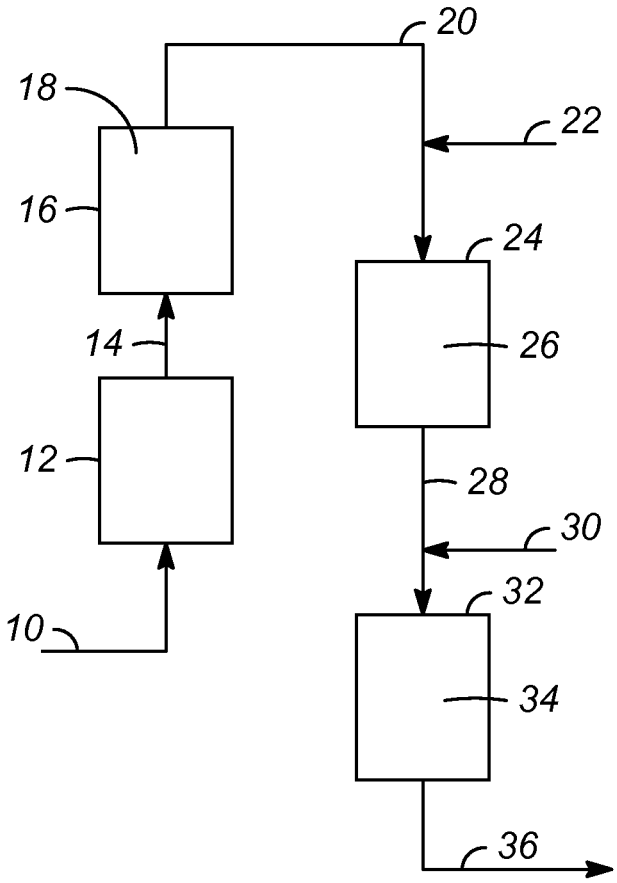
FIG. 3 is a schematic depiction of yet another embodiment of the method for saturating hydrocarbons.

In another embodiment as depicted in FIG. 3, the selective hydrogenation is performed over multiple reactors with inter-stage quenching. Inter-stage quenching may be accomplished via heat exchangers using the incoming hydrocarbon feed stream to remove the heat of saturation reaction. As illustrated in FIG. 3, hydrogen is divided and injected into the reactors so to operate saturation of individual olefins under optimized process conditions. Saturations of ethylene and propylene are thermodynamically favorable and can be substantially saturated at stoichiometric $H_2$ to olefin ratio and over wide temperature ranges. In contrast, saturation of butenes and especially isobutylene are thermodynamically limited and substantial conversions are favored at $H_2$ to olefin ratios appreciably higher than stoichiometric ratios and lower temperatures. Preferably the stoichiometric amount of $H_2$ required to saturate ethylene and propylene will be injected in the lead reactors, while the remaining unreacted $H_2$, in excess of saturating ethylene and propylene, is injected into the lag reactors. Furthermore, in this embodiment the reacting effluent coming of the lead reactors, where the substantial saturation of ethylene and propylene takes place, would be quenched before combining with make-up $H_2$ stream and entering the lag reactor. Here, the saturation of butenes and especially isobutylene would take place under a process environment of lower temperatures and high $H_2$ to butene ratio to drive complete conversions.

In one embodiment as depicted in FIG. 3, the hydrocarbon feed 10 passes through a dryer 12 producing a dried hydrocarbon stream 14. The dried hydrocarbon stream 14 passed through a guard bed 16 to remove $H_2O$, $H_2S$ and other sulfur containing compounds to give a pretreated hydrocarbon stream 20 of reduced contents of $H_2O$, $H_2S$ and sulfur containing compounds. The amounts of $H_2O$ and sulfur contents in the feed are around 10-1000 and 20-1000 mol ppm (on an elemental sulfur basis), respectively. The amounts of $H_2O$ and sulfur containing compounds in the pretreated stream 20 are less than 20 and 1 mol ppm and preferably less than 10 and 0.1 mol ppm, respectively. The pretreated hydrocarbon 20 is combined with a first $H_2$ stream 22 and then enters a first selective hydrogenation reactor 24. The first selective hydrogenation reactor 24 contains the selective hydrogenation catalyst 26. The first selective hydrogenation reactor effluent 28 is combined with a second $H_2$ stream 30 and then enters a second selective hydrogenation reactor 32. The second selective hydrogenation reactor 32 contains the selective hydrogenation catalyst 34. In another embodiment, the dried hydrocarbon stream 14 may not pass over the guard bed 16 but it may pass directly to the first selective hydrogenation reactor 24.

The first selective hydrogenation catalyst 26 and the second selective hydrogenation catalysts 34 are made up of at a least one hydrogenation component selected from Groups 6 through 10 supported on inorganic oxides to effect the utilization. Preferably the hydrogenation catalysts are made up of chromium, molybdenum, tungsten, nickel, cobalt, palladium, platinum, copper, zinc, silver and the mixture of thereof, supported in inorganic oxides such as alumina, silica, magnesia and the mixture of thereof. In addition alkali and alkali earth elements may be included. It is contemplated that the first selective hydrogenation catalyst 26 and the second selective hydrogenation catalyst 34 may be the same. However, it is also contemplated that the first selective hydrogenation catalyst 26 and the second selective hydrogenation catalyst 34 may be different.

In this embodiment the butadiene and olefin are preferentially saturated at levels of greater than 60% and preferably greater than 80% with aromatics saturations maintained at less than 10%, preferably less than 5% and most preferably less than 2%. The operating pressures of the lead reactors range from 40 psig to 300 psig and temperatures range from 60° C. to 350° C. and hydrogen to ethylene and propylene molar ratios from about 0.5 to about 1.2. The operating pressures of lag reactors range from 70 psig to 400 psig and temperatures range from 60° C. to 280° C. and hydrogen to butene molar ratios from about 1.2 to about 5.0. The space velocity of the lead reactor ranges from 4 to 100 hr−1, which that of the lag reactor ranges from 4 to 30 hr−1 WHSV.

EXAMPLES

The following examples are intended to further illustrate the subject embodiments. These illustrations of embodiments are not meant to limit the claims of this subject matter to the particular details of these examples. These examples are based on pilot plant data.

As shown in Table 1, catalysts A and B were tested for selective hydrogenation of olefins in the feed stream where the feed stream contains both olefins and aromatics. Catalysts A and B are palladium containing catalysts supported on alumina. The alumina may include gamma and theta alumina Palladium is placed within 100 um from the exterior of the support. Catalyst B may contain lithium as well.

TABLE 1

| catalyst | A | B |
|---|---|---|
| support | gamma Al2O3 | theta-Al2O3 |
| cat shape | extrudate | sphere |
| Wt % metal | 0.5% Pd | 0.25% Pd, 0.21% Li |

The catalysts were tested in a fixed bed reactor using 6 ml of catalyst mixed with quartz sand to minimize the axial dispersion. The composition of the feed stream is shown in Table 2. Test conditions include 100 psig pressure over temperatures of 100° C. to 300° C. inlet temperatures and $H_2$ to total olefin molar ratios from about 0.7 to about 3.5 with WHSV of about 11 hr−1.

TABLE 2

| Component | Wt % | mol % |
|---|---|---|
| Ethylene | 3.42 | 4.90 |
| Ethane | 22.45 | 30.06 |
| Propylene | 4.10 | 3.92 |
| Propane | 59.44 | 54.27 |
| 1-butene | 1.34 | 0.96 |
| Isobutylene | 0.81 | 0.58 |
| Normal Butane | 5.10 | 3.53 |
| Isobutane | 0.92 | 0.64 |
| 1,3 Butadiene | 0.03 | 0.02 |
| Benzene | 1.20 | 0.62 |
| Toluene | 0.72 | 0.31 |
| EB | 0.09 | 0.03 |
| pX | 0.14 | 0.05 |
| mX | 0.22 | 0.08 |
| oX | 0.03 | 0.01 |

Example 1

Catalyst A was tested as per the prescribed procedure described above. The results are shown in Table 3. As shown in Table 3 and Table 4, butadiene conversions are consistently at 100%. Olefin conversions are consistently greater than 90%. These results occur when $H_2$ to olefin molar ratios are greater than 1.0 at about 70 psig and 100 psig overall pressures over a temperature range from about 150° C. to about 220° C. bed temperatures. While the olefin conversions are high, the aromatics conversions are consistently below 2%.

TABLE 3

| Selective hydrogenation of Catalyst A at 110 psig | | | |
|---|---|---|---|
| inlet temperature, ° C. | 160 | 160 | 160 |
| bed temperature, ° C. | 179 | 181 | 182 |
| pressure, psig | 110 | 110 | 110 |
| H2/olefin molar ratio | 0.98 | 1.17 | 1.37 |
| C2 = conversion, % | 97 | 99.9 | 99.9 |
| C3 = conversion, % | 84.3 | 99.6 | 99.7 |
| C4 = conversion, % | 72.6 | 97.9 | 100 |
| butadiene conversion, % | 100 | 100 | 100 |
| aromatics conversion, % | 0 | 0.12 | 1.71 |

TABLE 4

| Selective Hydrogenation of Catalyst A at 72 psig | | | | | | | |
|---|---|---|---|---|---|---|---|
| inlet temperature, ° C. | 130 | 200 | 160 | 130 | 130 | 160 | 130 |
| bed temperature, ° C. | 152 | 214 | 179 | 154 | 155 | 179 | 155 |

TABLE 4-continued

| Selective Hydrogenation of Catalyst A at 72 psig | | | | | | | |
|---|---|---|---|---|---|---|---|
| pressure, psig | 73 | 73 | 73 | 72 | 73 | 73 | 73 |
| H2/olefin molar ratio | 0.98 | 1.17 | 1.17 | 1.17 | 1.37 | 1.37 | 1.56 |
| HOS | 106 | 155 | 135 | 112 | 118 | 139 | 170 |
| C2= conversion, % | 98.3 | 99.4 | 99.5 | 99.7 | 99.7 | 99.7 | 99.8 |
| C3= conversion, % | 82.4 | 97.7 | 98 | 98.7 | 98.9 | 98.6 | 98.7 |
| C4= conversion, % | 65.3 | 97.9 | 94.7 | 95.6 | 97.2 | 96.9 | 96.9 |
| butadiene conversion, % | 100 | 100 | 100 | 100 | 100 | 100 | 100 |
| aromatics conversion, % | 0 | 0 | 0 | 0 | 0.16 | 0.21 | 0.22 |

Example 2

Catalyst B was tested as per the prescribed procedure described above. The results are shown in Table 5. As shown in the Table 5, olefin conversions are consistently greater than 90% when $H_2$ to olefin molar ratios are greater than 1.0 at about 100 psig overall pressures and over a temperature range about 200° C. bed temperatures. While the olefin conversions are high, the aromatics conversions are consistently below 2%.

TABLE 5

| Selective hydrogenation of Catalyst B at 103 psig | | | | | |
|---|---|---|---|---|---|
| inlet temperature, ° C. | 130 | 133 | 130 | 131 | 130 |
| bed temperature, ° C. | 171 | 177 | 172 | 172 | 172 |
| pressure, psig | 103 | 103 | 103 | 104 | 103 |
| H2/olefin molar ratio | 1.16 | 1.28 | 1.36 | 1.55 | 1.74 |
| C2 = conversion, % | 100 | 100 | 100 | 100 | 100 |
| C3 = conversion, % | 99.9 | 99.4 | 100 | 100 | 100 |
| C4 = conversion, % | 94.9 | 95.5 | 97.8 | 100 | 100 |
| butadiene conversion, % | 100 | 100 | 100 | 100 | 100 |
| aromatics conversion, % | 0.03 | 0.07 | 0.21 | 0.69 | 0.93 |

It should be noted that various changes and modifications to the presently preferred embodiments described herein will be apparent to those skilled in the art. Such changes and modifications may be made without departing from the spirit and scope of the present subject matter and without diminishing its attendant advantages.

SPECIFIC EMBODIMENTS

While the following is described in conjunction with specific embodiments, it will be understood that this description is intended to illustrate and not limit the scope of the preceding description and the appended claims.

A first embodiment of the invention is a method for saturating hydrocarbons comprising passing a hydrocarbon stream comprising butadiene to a guard bed wherein the hydrocarbon stream is contacted with an adsorbent to form a treated hydrocarbon stream; and passing the treated hydrocarbon stream and a hydrogen stream to a reaction zone containing a hydrogenation catalyst to form a reaction zone effluent stream. An embodiment of the invention is one, any or all of prior embodiments in this paragraph up through the first embodiment in this paragraph, wherein the hydrocarbon stream comprises light paraffins, olefins, diolefins mainly butadiene, and aromatics, water, hydrogen sulfide, and other sulfur containing compounds. An embodiment of the invention is one, any or all of prior embodiments in this paragraph up through the first embodiment in this paragraph, wherein the treated hydrocarbon stream comprise $C_2$-$C_4$ paraffin and olefins, diolefins mainly butadiene, and aromatics. An embodiment of the invention is one, any or all of prior embodiments in this paragraph up through the first embodiment in this paragraph, wherein the guard beds contains molecular sieves to remove $H_2O$. An embodiment of the invention is one, any or all of prior embodiments in this paragraph up through the first embodiment in this paragraph, wherein the guard beds contains molecular sieves to remove $H_2O$ and $H_2S$. An embodiment of the invention is one, any or all of prior embodiments in this paragraph up through the first embodiment in this paragraph, wherein the guard beds contain molecular sieves and metal or metal oxides that are capable of going through reduction-oxidation cycle to remove $H_2S$ and other sulfur containing compounds. An embodiment of the invention is one, any or all of prior embodiments in this paragraph up through the first embodiment in this paragraph, wherein the reaction zone does not saturate more than 20% of aromatics in the treated hydrocarbon stream. An embodiment of the invention is one, any or all of prior embodiments in this paragraph up through the first embodiment in this paragraph, wherein the reaction zone comprises multiple reactors in series having inter-stage quenching. An embodiment of the invention is one, any or all of prior embodiments in this paragraph up through the first embodiment in this paragraph, wherein the inter-stage quenching includes dividing $H_2$ and injecting it into individual reactors. An embodiment of the invention is one, any or all of prior embodiments in this paragraph up through the first embodiment in this paragraph, wherein the reaction zone operates at a temperature from about 60° C. (140° F.) to about 350° C. (662° F.). An embodiment of the invention is one, any or all of prior embodiments in this paragraph up through the first embodiment in this paragraph, wherein the reaction zone operates at a pressure from about 40 psig to about 300 psig. An embodiment of the invention is one, any or all of prior embodiments in this paragraph up through the first embodiment in this paragraph, further comprising contacting the treated hydrocarbon stream with the hydrogenation catalyst in the reaction zone to selectively hydrogenate butadiene and olefins. An embodiment of the invention is one, any or all of prior embodiments in this paragraph up through the first embodiment in this paragraph, wherein the hydrogenation catalyst comprise at least one active metals chosen from Groups 6 through 10. An embodiment of the invention is one, any or all of prior embodiments in this paragraph up through the first embodiment in this paragraph, wherein the hydrogenation catalyst comprises one of more of transition metals nickel, palladium, platinum, rhodium, iridium or mixtures thereof supported on inorganic metal oxides. An embodiment of the invention is one, any or all of prior embodiments in this paragraph up through the first embodiment in this paragraph, wherein the hydrocarbon stream comprises olefins and the reaction zone effluent stream comprises a reduced olefin content relative to the treated hydrocarbon stream. An embodiment of the invention is one, any or all of prior embodiments in this paragraph up through the first embodiment in this paragraph, wherein hydrogenation catalyst contains at least one Group VIII metal selected from nickel, palladium, platinum and mixtures thereof supported on an inorganic oxide. An embodiment of the invention is one, any or all of prior embodiments in this paragraph up through the first embodiment in this paragraph, wherein overall $H_2$ to olefin molar ratios range from 0.5 to 5.0. An embodiment of the invention is one, any or all of prior embodiments in this paragraph up through the first embodiment in this paragraph, wherein the guard bed operates over a cycle from 2 to 48 hours. An embodiment of the invention is one, any or all of prior embodiments in this paragraph up through the first embodiment in this paragraph, wherein diolefins comprise greater than 50% butadiene. An embodiment of the invention is one, any or all of prior embodiments in this paragraph up through the first embodiment in this paragraph, wherein diolefins comprise greater than 50% butadiene.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A method for saturating hydrocarbons comprising:

providing a hydrocarbon stream comprising paraffins having 4 or less carbon atoms, C2-C4 olefins, diolefins, aromatics, $H_2O$, $H_2S$, and other sulfur containing compounds, wherein the hydrocarbon stream comprises a portion of an effluent from a dehydrocyclodimerization reaction zone;

passing the hydrocarbon stream to a guard bed and contacting the hydrocarbon stream with an adsorbent to remove $H_2O$, $H_2S$, and other sulfur containing compounds and form a treated hydrocarbon stream; and passing the treated hydrocarbon stream and a hydrogen stream to a reaction zone containing a hydrogenation catalyst to selectively hydrogenate the olefins and diolefins in the treated hydrocarbon stream and form a reaction zone effluent stream, wherein greater than about 60% by weight of the olefins are saturated, greater than about 80% by weight of the diolefins are saturated, and no more than 20% by weight of the aromatics are saturated.

2. The method of claim 1, wherein the guard bed contains molecular sieves to remove $H_2O$.

3. The method of claim 1, wherein the guard bed contains molecular sieves to remove $H_2O$ and $H_2S$.

4. The method of claim 1, wherein the guard bed contains molecular sieves and metal or metal oxides that are capable of going through reduction-oxidation cycle to remove $H_2S$ and other sulfur containing compounds.

5. The method of claim 1, wherein the reaction zone comprises multiple reactors in series having inter-stage quenching.

6. The method of claim 5, wherein the inter-stage quenching includes dividing $H_2$ and injecting it into individual reactors.

7. The method of claim 1, wherein the reaction zone operates at a temperature from about 60° C. (140° F.) to about 350° C. (662° F.).

8. The method of claim 1, wherein the reaction zone operates at a pressure from about 40 psig to about 300 psig.

9. The method of claim 1, wherein the hydrogenation catalyst comprises at least one active metal chosen from Groups 6 through 10.

10. The method of claim 1, wherein the hydrogenation catalyst comprises one or more transition metals selected from nickel, palladium, platinum, rhodium, iridium and mixtures thereof supported on inorganic metal oxides.

11. The method of claim 1, wherein the hydrogenation catalyst comprises at least one Group VIII metal selected from nickel, palladium, platinum and mixtures thereof supported on an inorganic oxide.

12. The method of claim 1, wherein an overall $H_2$ to olefin molar ration in the reaction zone range from 0.5 to 5.0.

13. The method of claim 1, wherein the guard bed operates over a cycle from 2 to 48 hours.

14. The method of claim 1, wherein the diolefins comprise greater than 50% by weight butadiene.

15. The method of claim 1, further comprising:

passing a feed stream comprising aliphatic hydrocarbons to a dehydrocyclodimerization reaction zone to form a reaction mixture comprising aromatics, C4+ non-aromatics byproduct, a light ends byproduct comprising C1-C2 hydrocarbons, C2-C4 olefins, diolefins, unconverted aliphatic hydrocarbons, $H_2O$, $H_2S$, and other sulfur containing compounds;

separating the reaction mixture to form the hydrocarbon stream.

16. The method of claim 15, further comprising:

recycling the reaction zone effluent stream to the dehydrocyclodimerization reaction zone.

* * * * *